US008646200B2

(12) United States Patent
Rendulic

(10) Patent No.: US 8,646,200 B2
(45) Date of Patent: Feb. 11, 2014

(54) AMMUNITION MAGAZINE WITH AN IMPROVED MAGAZINE BASE LOCKING

(75) Inventor: Mario Rendulic, Karlovac (HR)

(73) Assignee: HS Produkt D.O.O., Karlovac (HR)

( * ) Notice: Subject to any disclaimer, the term of this patent is extended or adjusted under 35 U.S.C. 154(b) by 0 days.

(21) Appl. No.: 13/885,243

(22) PCT Filed: Nov. 28, 2011

(86) PCT No.: PCT/HR2011/000043
§ 371 (c)(1),
(2), (4) Date: May 14, 2013

(87) PCT Pub. No.: WO2012/073052
PCT Pub. Date: Jun. 7, 2012

(65) Prior Publication Data

US 2013/0227870 A1 Sep. 5, 2013

(30) Foreign Application Priority Data

Nov. 30, 2010 (HR) ..... P 20100655 A

(51) Int. Cl.
*F41A 9/61* (2006.01)

(52) U.S. Cl.
USPC ..... 42/50; 42/49.01; 42/49.02; 224/196

(58) Field of Classification Search
USPC ..... 42/49.01, 49.02, 49.1, 50; 224/196, 931
See application file for complete search history.

(56) References Cited

U.S. PATENT DOCUMENTS

| | | | | |
|---|---|---|---|---|
| 4,397,453 | A | 8/1983 | Seecamp | |
| 4,862,618 | A | 9/1989 | Szabo | |
| 4,862,619 | A | 9/1989 | Baldus et al. | |
| 7,797,871 | B2 * | 9/2010 | Bubits | 42/49.01 |
| 2008/0028661 | A1 * | 2/2008 | Bubits | 42/49.01 |

FOREIGN PATENT DOCUMENTS

| | | | |
|---|---|---|---|
| EP | 1 568 962 | A1 | 8/2005 |
| HR | P2008055 | A2 | 5/2010 |
| WO | WO 2005/075929 | A2 | 8/2005 |

OTHER PUBLICATIONS

International Search Report and Written Opinion for PCT/HR2011/0000043 mailed Mar. 19, 2012.

* cited by examiner

*Primary Examiner* — Stephen M Johnson
*Assistant Examiner* — Joshua Freeman
(74) *Attorney, Agent, or Firm* — RatnerPrestia

(57) ABSTRACT

An ammunition magazine with an improved base locking, including: a hollow magazine body, a follower, a spring and a magazine base. The magazine body is equipped with track guides that correspond to grooves embodied on the magazine base, that the magazine base is guided onto. The spring is spirally embodied such that the first turn fully encompasses the surface of the magazine base and in the compressed state the rest of the spring, without the first turn, can fully fit into the follower pressed by the spring. The magazine base has a catch on one side and a hole positioned next to the catch. The magazine body has a slit allowing the catch to pass unobstructed into the magazine body and catch the detent spot on the spring positioned inside the magazine body. An advantage is improved safety of magazine base locking to the magazine body and simpler construction.

3 Claims, 5 Drawing Sheets

AMMUNITION MAGAZINE WITH AN IMPROVED MAGAZINE BASE LOCKING

CROSS REFERENCE TO RELATED APPLICATIONS

This application is the U.S. National Phase Application of PCT/HR2011/000043, filed Nov. 28, 2011, which claims priority to Croatian Patent Application No. P20100655A, filed Nov. 30, 2010, the contents of such applications being incorporated by reference herein.

FIELD OF THE INVENTION

The subject invention refers to the improved magazine base locking on automatic pistols and other firearms. The subject invention can be classified into the functional parts of the firearm, specifically magazines that have a spring-pressed follower; where the rounds are stacked offset in a staggered configuration within the magazine; and where the present technical solution of magazine base locking increases the capacity of the magazine.

TECHNICAL PROBLEM

Ammunition magazines with a spring operated follower have been used for a long time with different types of firearms, including automatic rifles and handguns. The magazine of a pistol is usually situated in the grip. Due to such specific position, the way the magazine base locks to the magazine body, i.e. the way it is constructed, affects the number of cartridges a magazine can hold. If a base locking construction takes up a small volume, it is possible to get an extra space for one more round in the magazine.

The first technical problem the subject invention solves refers to the locking of the magazine base to the magazine body in a way that the volume taken up by the locking mechanism is minimised, thus allowing additional space for ammunition.

The second technical problem solved by the subject invention is the magazine base locking embodiment which is more reliable than technical solutions in the prior art.

STATE OF ART

The state of art is extremely rich and it includes patent and non-patent literature. Among the technical solutions in patent literature we find the US patent filed in 1988 and published as U.S. Pat. No. 4,862,618 (SZABO, Attila), which is incorporated here by reference, which teaches about the procedure of converting a semiautomatic Colt pistol, model 1911A1, into a pistol with an increased magazine capacity, modified from 7 rounds to 13 rounds. The subject invention discloses the magazine in which the ammunition is stacked in a staggered configuration and where the follower is pressed by the spring that rests on the magazine base like in the present invention. This prior art solution does not teach about the way the spring and the magazine base are connected.

The second technical solution is the international patent application PCT/IB2005/000292 from 2005 published as WO2005075929 (inventor BUBITS, Wilhelm), which is incorporated herein by reference, which teaches about the construction of the magazine, same as the present invention. In the said solution, the magazine base is locked to the magazine body by a spring which, on its first bent section that rests on the magazine base, has a U-shaped end that fits inside the magazine base thus locking the base to the magazine body.

The third technical solution is a Croatian patent application from 2008 published as HR20080555 (HS PRODUKT Ltd), which is incorporated herein by reference, which discloses a solution similar to the one we can find in PCT/IB2005/000292; i.e. the magazine base is locked by a spring that fits into the magazine base with its V-shaped end section.

So, WO2005075929 can be identified as the earliest and the closest technical solution from prior art. The difference between the said technical solution and the technical solution according to the present invention is the fact that in the present invention the base is locked via a specially constructed catch on the magazine base that catches a part of the spring. The advantage of such a solution is a simpler embodiment of the spring and increased security of locking.

THE SUMMARY OF THE INVENTION

The subject invention refers to the ammunition magazine with an improved base locking, comprising: the hollow magazine body, the magazine follower, the spring and the magazine base. The magazine body has track guides which fit into the grooves in the magazine base that the magazine base slides onto. The spring is spirally embodied in such a way that its first turn fully encompasses the magazine base and, in its compressed state, the rest of the spring (without the first turn) fully fits inside the follower pressed by the said spring. The magazine base has a catch on one side and a hole placed immediately next to the catch. The magazine body has a slit that allows the catch to pass freely into the magazine body and to catch a part of the spring mounted inside the magazine body. The advantage of this technical solution is the improved safety of magazine base locking and a simpler embodiment.

BRIEF DESCRIPTION OF THE FIGURES

One of the possible embodiments according to the subject invention is shown in FIGS. 1-9.

DETAILED DESCRIPTION OF THE INVENTION

Figure 1:
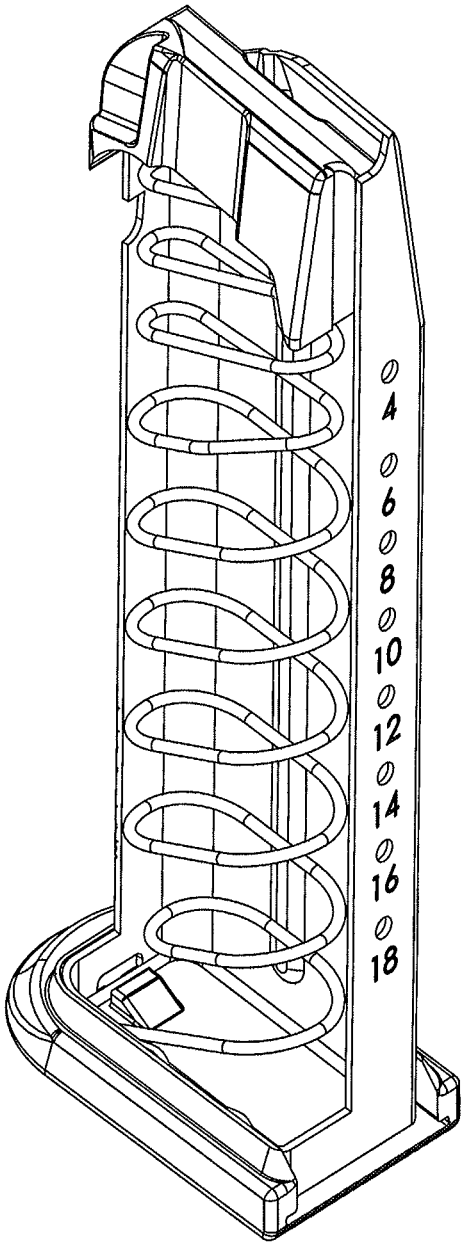
FIG. 1 shows a sectional view of the hollow body of the whole magazine to show the spatial layout of its constituent parts in a state when the base is locked.
Figure 2:
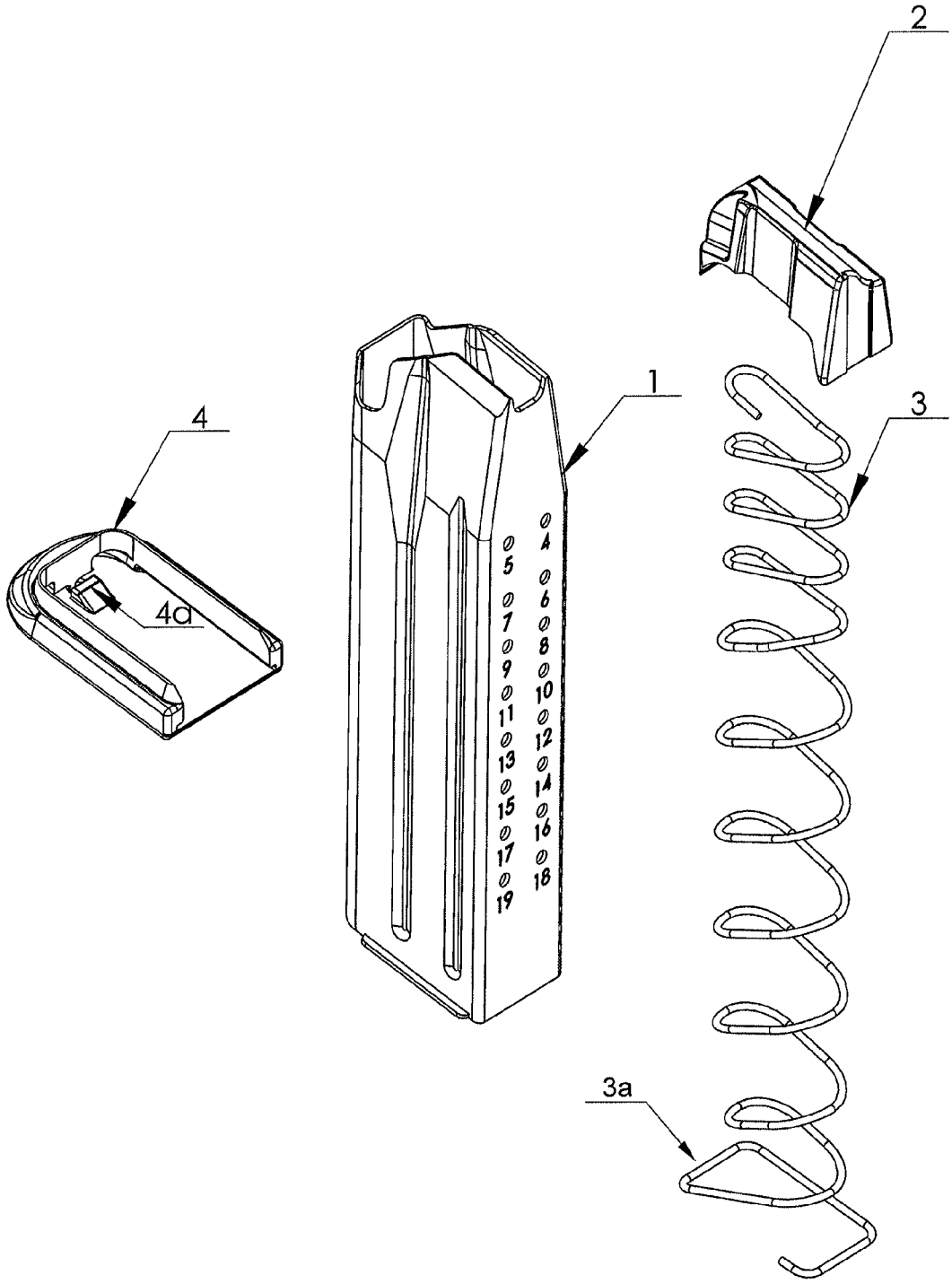
FIG. 2 shows the four basic parts of the magazine.
Figure 3:
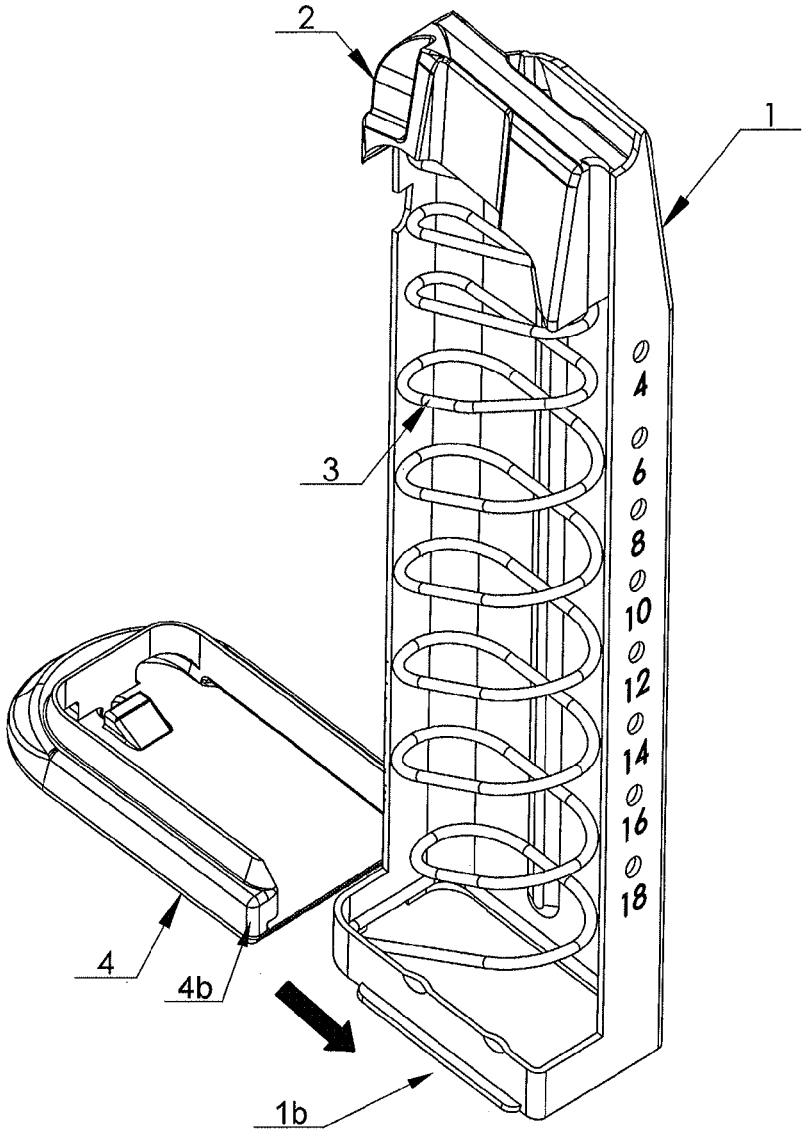
FIG. 3 shows a way of locking the magazine base, i.e. the procedure of slideably attaching the magazine base onto the magazine body in a perspective view.

The magazine shown in FIG. 1 consists of parts shown in FIG. 2. The basis is the magazine body (1) which is a cavity within which other parts of the magazine are placed. The magazine body (1) is adjusted to be inserted into the mechanism of a handgun or some other firearm with its top geometry and it is slanted in a way known in the state of art, which allows the rounds stacked in a staggered configuration inside the magazine to come out one at the time. One side wall contains numbered holes that allow the operator to visually check how many rounds are remaining in the magazine. The bottom part of the magazine body (1) is completely open and the follower (2) and the spring (3) are inserted into the magazine through it. After that, the magazine base (4) is locked onto the magazine body (1). FIG. 3 shows the track guides (1*b*) on the very bottom of the magazine body (1) which fit into the compatible grooves (4*b*) on the magazine base (4). Such a way of attaching the magazine base (4) onto the magazine body (1) is known in the above-mentioned state of art.

Figure 8:
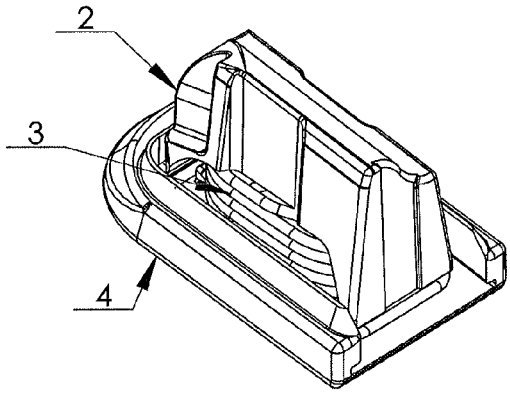
FIG. 8 shows the maximally compressed state of the spring within the follower (without the drawing of the magazine body)

The follower (2) is constructed in a way known previously known in the state of art. The follower (2) can move under spring (3) tension through the magazine body (1), simultaneously pushing the rounds stacked in a staggered configuration into the mechanism of a pistol or, some other firearm. The construction of the follower (2) allows for the whole spring (3), except for the its first turn, to be fully fitted inside the follower (2) as shown in FIGS. 8 and 9A.

Figure 7:
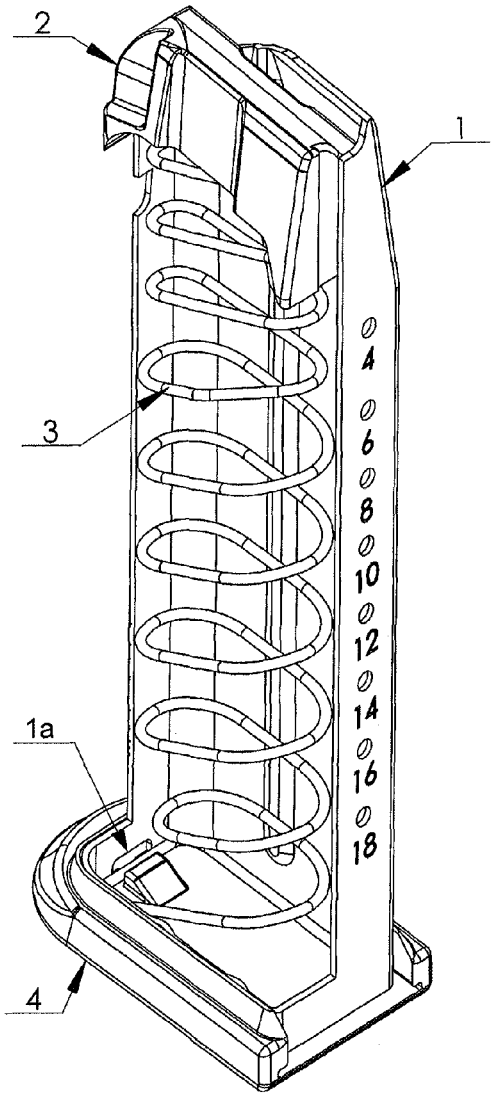
FIG. 7 shows the final position of parts in a locked magazine.
Figure 9A:
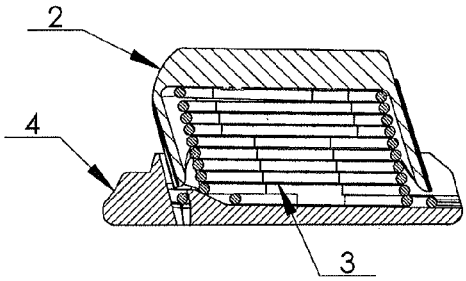
FIG. 9A shows the sectional side view, and FIG. 9B a perspective view of the same state.
Figure 9B:
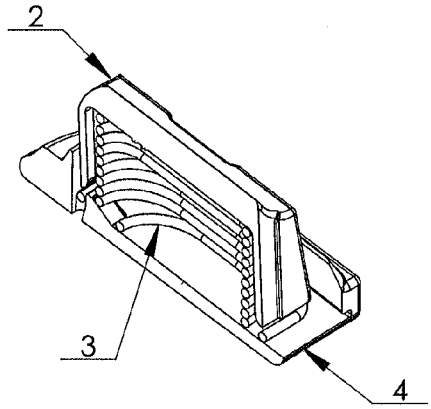

The spring (3) is of a spiral shape and its first turn on one side follows the shape of the magazine base (4) and the cross-section of the magazine body (1) as is shown in FIGS. 7 and 2; the other side of the spring is embodied in such a way that once it is fully compressed, it can fit into a defined minimal space of the follower (2), FIGS. 9A, 9B. This is shown in FIG. 2 where the spring (3) is shown in an expanded position. The first turn on the very bottom of the spring (3) with which the spring (3) abuts the magazine base (4) follows the shape of the magazine body (1), while the next turn has a much smaller surface—so it does not obstruct the catch (4*a*) on the magazine base (4), FIGS. 9A, 9B. When compressed, the other turns of the spring (3) follow the inner geometry of the follower (2) as is shown in FIGS. 8 and 9B. Similar solutions are known in prior art. A big difference in comparison to previous technical solutions is a completely straight first turn of the spring and the detent spot (3*a*) on the spring—which is not documented in the state of the art, same as the reduced surface of the first subsequent turn of the spring (3).

Figure 6:
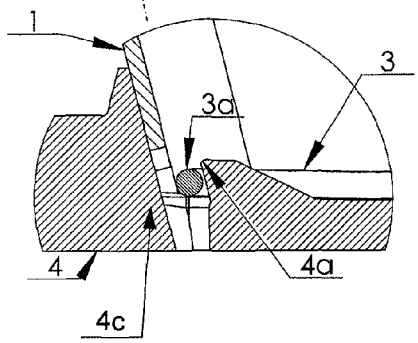
FIG. 6 shows the magnified part of FIG. 5B marked by a circle.

The construction of the magazine base (4) is standard in one part; it includes grooves (4*b*) for fitting the track guides (1*b*) of the magazine body, one groove on each side. But the magazine base has a catch (4*a*) which protrudes towards the inside of the magazine body (1), FIG. 3, and which is not documented in the state of art. The catch (4*a*) has a 20°-60° slant on one side, and on its other side there is a hole (4*c*) which is centrally positioned and embodied through the magazine base (4) immediately next to the catch (4*a*) as is shown in FIG. 6. Before the magazine base (4) is locked, the slant is facing towards the magazine body (1) and the hole (4*c*) is facing the opposite side as shown in FIG. 4.

The role of the catch (4*a*) is to lift the detent spot (3*a*) with its slanting side in the process of assembly and to catch the detent spot (3*a*) with the part of the catch facing the hole (4*c*). The hole (4*c*) allows for the disassembly of the magazine into its constituent parts.

Figure 4:
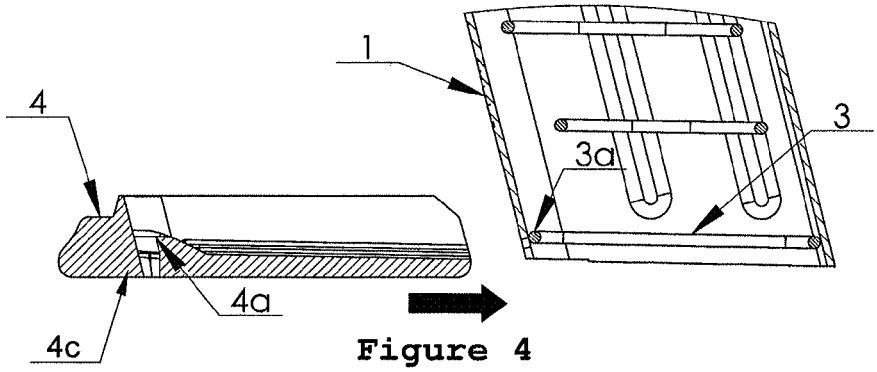
FIG. 4 shows the same action, but in a sectional side view with the focus on the position of the magazine base and the spring placed into the bottom part of the magazine body.
Figure 5A:
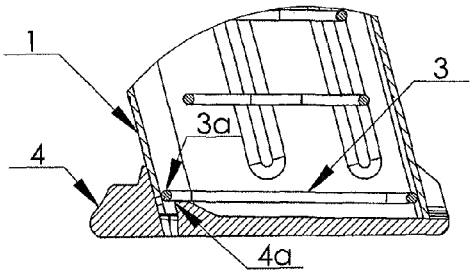
FIG. 5A shows the moment when the catch on the magazine base passes beneath the spring that locks the magazine base.
Figure 5B:
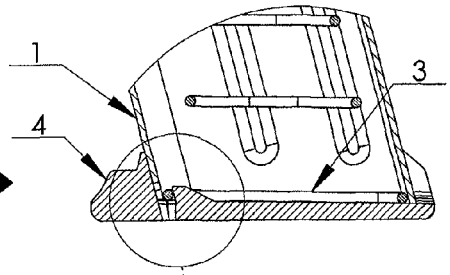
FIG. 5B shows the locked position of the magazine base.

FIGS. 3 and 4 show the procedure of magazine assembly. When the follower (2) and the spring (3) are placed within the magazine body (1), the magazine base (4) is slid carefully onto the track guides (1*b*) with its grooves (4*b*), the dimensions of which fit the said guides. FIG. 5A shows the moment when the catch (4*a*), due to its specifically embodied slant, lifts the spring (3) in the detent spot (3*a*) while the magazine base (4) is guided onto the magazine body (1). As the magazine base (3) is pushed further, the detent spot (3*a*) skips behind the catch and locks the magazine base (4) onto the magazine body (1) as is shown in FIG. 5B and FIG. 6.

The spring (3) which completely rests on the magazine base (4) with its first turn, see FIG. 7, prevents the detaching/moving of the magazine base (4) in a way that on one side a part of the spring (3) with its detent spot (3*a*) gets permanently caught by the catch (4*a*) on the magazine base (4), while the outer part of the spring (3) pushes against the magazine body (1) as is shown in FIGS. 6 and 9B.

The disassembly is performed in a way that a screwdriver or a punch is inserted into the hole (4*c*), see FIG. 6, which allows for the part of the spring (3) caught by the catch (4*a*) to be lifted. Such unlocked magazine base (4) can be moved along the track guides (1*b*) just enough so that the detent spot reaches the top of the catch (4*a*). After that it is no longer necessary to act through the hole (4*c*) onto the spring (3), because relative sliding of the base (4) with regard to the body (1) allows for the detent spot (3*a*) to slide down the catch (4*a*) slope. Thus the base (4) is released from the magazine body (1) and the said magazine can be disassembled into its components for cleaning or parts replacement.

Procedures of magazine assembly or disassembly can be systematized in the following way described below:

Magazine assembly consists of three steps:

(i) Inserting the follower (2) and the spring (3) into the magazine base;

(ii) Placing the magazine base (4) with its grooves (4*b*) onto the track guides (1*b*) of the magazine body (1) while holding the spring (3) with your hand inside the magazine body (1) so it would lean onto the magazine base (4); and (iii) Pushing the magazine base (4) towards the magazine body (1) until the spring (3) jumps over the catch (4*a*) with its detent spot (3*a*) and locks the magazine base (4) in place on the magazine body (1), with a hole (4*c*) below the detent spot (3*a*).

The procedure of magazine disassembly also consists of three steps:

(i) Lifting a part of the spring (3) above the catch (4*a*) by acting mechanically onto a detent spot (3*a*) through the hole (4*c*) on the magazine base (4);

(ii) Pulling the magazine base (4) until the detent spot (3*a*) slides onto the catch (4*a*) which unlocks the magazine base (4); and (iii) Pulling the magazine base (4) further along the grooves (4*b*) off the track guides (1*b*) of the magazine body (1) which completely detaches the magazine base (4) from the magazine body (1).

The inventive step of the present solution of magazine base locking is that the connection of the part of the spring that gets caught with its detent spot (3*a*) between the catch (4*a*) and the magazine body (1) is firmer and more heat-stabile from the prior art connection "spring—magazine base—magazine body" where the connection is established by a part of the spring entering the magazine base (4). Being familiar with prior art documents mentioned here, an average person skilled in the art would look for potential other ways of connecting the magazine base and magazine body via the spring that has a differently embodied slot on one end that enters the magazine base in one or more places, and would not apply the technical solution in which the magazine base is elevated and a detent catch is formed. At first sight it seems that such a solution reduces the volume of the magazine. However, that is not the case, because the catch (4*a*) is placed entirely inside the follower (2) as is the spring (3)—except for its first turn, thus not taking up any extra space in the magazine, see FIGS. 9A and 9B.

In the end we have to say that the magazine body itself (1) must have, on its front wall—where the magazine base (4) gets placed onto the track guides, a space for unobstructed passing of the elevated catch (4*a*) marked in FIG. 7 as a position (1*a*). This opening (1*a*), from the point of view of an operator; is fully closed by the construction of the magazine base (4) which fully covers said opening (1*a*) when the magazine base is locked, as is marked in FIG. 5B. That prevents potential contamination of the inside of the magazine by dust and other impurities that might cause magazine mechanism failure.

INDUSTRIAL APPLICABILITY

Industrial applicability of the subject invention is obvious; the invention solves the problem of locking the magazine base (4) to the magazine body (1) via a spring (3) positioned centrally within the magazine body (1) which gets caught by the catch (4*a*) embodied on the magazine base (4).

REFERENCES

1—magazine body
1*a*—slit
1*b*—track guide
2—follower
3—magazine spring
3*a*—detent spot
4—magazine base
4*a*—catch
4*b*—groove for the track guide
4*c*—hole

The invention claimed is:

1. An ammunition magazine with an improved base locking, comprising a hollow magazine body, a follower, a spring and a magazine base;

where said magazine body is equipped with track guides which correspond with grooves on said magazine base that is slid onto;

where said follower is pressed by said spring which pushes against the magazine base with its first turn;

where said spring follows an inner shape of the magazine body with its first turn, while the second turn is embodied with a smaller cross-section so that a catch could be placed inside the follower, while other turns of the spring follow an inner geometry of the follower in such a way that the whole spring can be compressed into the follower; wherein:

the magazine base has the catch with a slanting side which protrudes into the space of the magazine body, and a hole embodied through the magazine base on the other side of the catch;

the magazine body has a slit that allows the catch to pass unobstructed into the inside of the magazine body in the process of attaching the magazine base onto the magazine body, and where the catch catches a detent spot on the first turn of the spring in a way that said detent spot is locked between the catch and the magazine body in the space above the hole.

2. A method of assembling an ammunition magazine according to claim 1, said magazine comprising a hollow magazine body, a follower, a spring and a magazine base, the method comprising:

(i) inserting the follower and the spring into the magazine body;

(ii) placing the grooves of the magazine base onto the track guides of the magazine body while holding the spring with your hand inside the magazine body so that the spring would rest on the magazine base; and (iii) pushing the magazine base toward the magazine body until the spring with its detent spot skips over the catch and locks the magazine base in place on the magazine body with a hole below the detent spot.

3. A method of disassembling an ammunition magazine according to claim 1, said magazine comprising a hollow magazine body, a follower, a spring and a magazine base, the method comprising:

(i) lifting a part of the spring above the catch onto the detent spot by acting mechanically through the hole on the magazine base;

(ii) pulling the magazine base until the detent spot slides onto the catch which unlocks the magazine base; and (iii) pulling the magazine base further along the grooves of the magazine body track guides which completely detaches the magazine base from the magazine body.

* * * * *